US008977187B2

(12) United States Patent
Nishimura

(10) Patent No.: US 8,977,187 B2
(45) Date of Patent: Mar. 10, 2015

(54) POST-PROCESSING DEVICE AND IMAGE FORMING APPARATUS

(71) Applicant: Kyocera Document Solutions Inc., Osaka (JP)

(72) Inventor: Jun Nishimura, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 155 days.

(21) Appl. No.: 13/779,333

(22) Filed: Feb. 27, 2013

(65) Prior Publication Data

US 2013/0223909 A1 Aug. 29, 2013

(30) Foreign Application Priority Data

Feb. 29, 2012 (JP) ..... 2012-042791

(51) Int. Cl.
*G03G 15/00* (2006.01)
*B65H 37/00* (2006.01)
*B42B 5/00* (2006.01)

(52) U.S. Cl.
CPC ..... *G03G 15/6544* (2013.01); *B42B 5/00* (2013.01); *G03G 15/6538* (2013.01)
USPC ..... 399/407; 399/21

(58) Field of Classification Search
CPC ..... G03G 15/00; G03G 21/00; B65H 37/00
USPC ..... 399/21, 407, 410
See application file for complete search history.

(56) References Cited

U.S. PATENT DOCUMENTS

| | | | | |
|---|---|---|---|---|
| 7,809,290 | B2 * | 10/2010 | Tamagaki | 399/21 |
| 2007/0057445 | A1 * | 3/2007 | Miyake et al. | 271/256 |
| 2009/0110411 | A1 * | 4/2009 | Gungor et al. | 399/20 |
| 2010/0143015 | A1 * | 6/2010 | Kubota et al. | 399/407 |
| 2010/0322640 | A1 * | 12/2010 | Yamada | 399/11 |
| 2011/0135365 | A1 * | 6/2011 | Oak et al. | 399/407 |
| 2011/0266738 | A1 | 11/2011 | Furuhashi et al. | |
| 2012/0091648 | A1 * | 4/2012 | Masunari et al. | 270/58.08 |

FOREIGN PATENT DOCUMENTS

| | | | | |
|---|---|---|---|---|
| JP | 08108968 A | * | 4/1996 | B65H 43/04 |
| JP | 2000086014 A | * | 3/2000 | G03G 15/00 |
| JP | 2011123153 A | * | 6/2011 | G03G 21/00 |

* cited by examiner

*Primary Examiner* — Nguyen Ha
(74) *Attorney, Agent, or Firm* — K&L Gates LLP

(57) ABSTRACT

A post-processing device supplies a recoding medium when a punching unit is determined to have failed. The post-processing device allows the recording medium to be supplied to a stapling unit if passage of the recording medium supplied to the punching unit through an arrangement position of a second sensor is detected within a first time period after detection of passage of the recoding medium through an arrangement position of a first sensor.

10 Claims, 3 Drawing Sheets

POST-PROCESSING DEVICE AND IMAGE FORMING APPARATUS

INCORPORATION BY REFERENCE

This application is based upon, and claims the benefit of priority from the corresponding Japanese Patent Application No. 2012-042791, filed on Feb. 29, 2012, the entire contents of which are incorporated herein by reference.

BACKGROUND

The present disclosure relates to a post-processing device that performs post-processing on a recording medium with an image formed thereon and to an image forming apparatus having the post-processing device.

Image forming apparatuses are known that include a main body of the image forming apparatus and a post-processing device. The main body forms an image on a recording medium (paper). The post-processing device performs post-processing such as, punching, stapling, and center-folding, on paper supplied from the main body. Specifically, the post-processing device includes a punching unit that performs punching, a stapling unit that performs stapling, and a center-folding unit that performs center-folding. The punching unit is closest to a port through which paper is supplied from the main body, and the stapling unit and center-folding unit are located downstream of the punching unit in the direction of transporting paper. In the post-processing device, paper passing through the punching unit is supplied to the stapling unit and center-folding unit.

Some of the post-processing devices include only one paper transport path. In one such post-processing device, even when punching is not performed, paper passes through the punching unit before being supplied to the stapling unit and center-folding unit. If the punching unit fails, the transport path for use in supplying paper to the stapling unit and center-folding unit may be blocked by the punching blade of the punching unit. To address this situation, if the punching unit in the post-processing device including only one paper transport path fails, all of the functions of the post-processing device are typically deactivated.

Unfortunately, deactivating all of the functions of the above-described post-processing device causes an inconvenience because the user cannot use the stapling unit and center-folding unit until, for example, a repairer fixes the punching unit.

SUMMARY

A post-processing device according to an embodiment of the present disclosure includes a post-processing recording-medium transporting unit, a punching unit, a stapling unit, a first sensor, a second sensor, a determining unit, and a transport controller. The post-processing recording-medium transporting unit feeds a recording medium. The punching unit creates a hole in the recording medium. The stapling unit is located downstream of the punching unit in a transporting direction of the recording medium. The first sensor is used for detecting the recording medium fed by the post-processing recording-medium transporting unit and is located upstream of the punching unit in the transporting direction of the recording medium. The second sensor is used for detecting the recording medium fed by the post-processing recording-medium transporting unit and is located downstream of the punching unit in the transporting direction of the recording medium and upstream of the stapling unit in the transporting direction of the recording medium. The determining unit determines whether the punching unit fails. The transport controller controls the post-processing recording-medium transporting unit such that, when the determining unit determines that the punching unit fails, the recording medium is supplied to the punching unit and, if passage of the recording medium through an arrangement position of the second sensor is detected within a predetermined first time period after detection of passage of the recording medium through an arrangement position of the first sensor, the recording medium is allowed to be supplied to the stapling unit.

An image forming apparatus according to another embodiment of the present disclosure includes a main device for forming an image on a recording medium and a post-processing device for performing post-processing on the recording medium. The post-processing device includes a post-processing recording-medium transporting unit, a punching unit, a stapling unit, a first sensor, a second sensor, a determining unit, and a transport controller. The post-processing recording-medium transporting unit feeds the recording medium. The punching unit creates a hole in the recording medium. The stapling unit is located downstream of the punching unit in a transporting direction of the recording medium. The first sensor is used for detecting the recording medium fed by the post-processing recording-medium transporting unit and is located upstream of the punching unit in the transporting direction of the recording medium. The second sensor is used for detecting the recording medium fed by the post-processing recording-medium transporting unit and is located downstream of the punching unit in the transporting direction of the recording medium and upstream of the stapling unit in the transporting direction of the recording medium. The determining unit determines whether the punching unit fails. The transport controller controls the post-processing recording-medium transporting unit such that, when the determining unit determines that the punching unit fails, the recording medium is supplied to the punching unit and, if passage of the recording medium through an arrangement position of the second sensor is detected within a predetermined first time period after detection of passage of the recording medium through an arrangement position of the first sensor, the recording medium is allowed to be supplied to the stapling unit.

Additional features and advantages are described herein, and will be apparent from the following Detailed Description and the figures.

DETAILED DESCRIPTION

Figure 1:
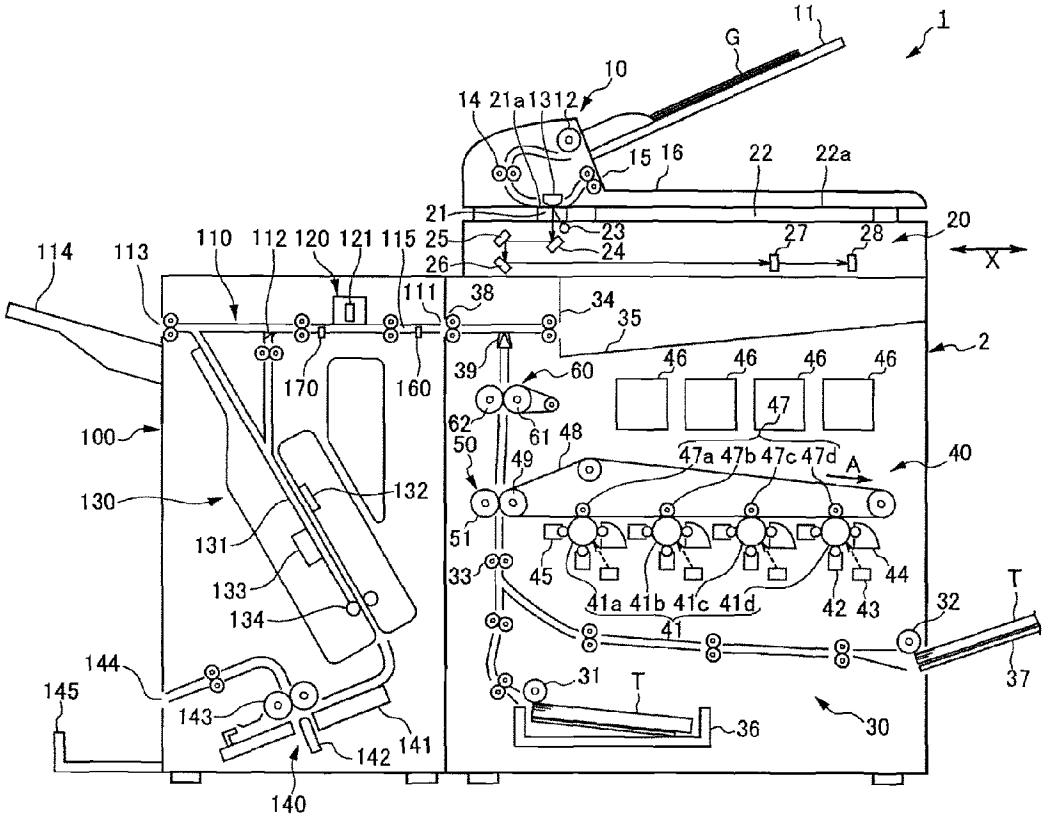
FIG. 1 illustrates a configuration of a copier according to an embodiment of an image forming apparatus.

An embodiment of a post-processing device and image forming apparatus of the present disclosure is described below with reference to the drawings. First, a general configuration of a copier 1 as the image forming apparatus is described. FIG. 1 illustrates the configuration of the copier 1 according to an embodiment of the image forming apparatus.

As illustrated in FIG. 1, the copier 1, according to an embodiment, includes a copier main body 2 as a main device that forms a toner image on paper T as a recording medium and a post-processing device 100 that performs punching, stapling, and center-folding as post-processing on the paper T with the toner image formed thereon. The post-processing device 100 is adjacent to the paper discharge side of the copier main body 2.

The copier main body 2 includes a document transporting unit 10, a document reading unit 20, a paper transporting unit 30 as a recording-medium transporting unit, an image forming unit 40, a transfer unit 50, and a fixing unit 60.

The document transporting unit 10 is an automatic document feeder (ADF) and includes a document plate 11, a first feed roller 12, a guide 13, a pair of timing rollers 14, and a document discharging unit 15. The first feed roller 12 sequentially supplies documents G on the document plate 11 one at a time to the pair of timing rollers 14. The pair of timing rollers 14 feeds the document G or stops feeding the document G to match the timing of supplying the document G to the location where an image of the document G is to be read by the document reading unit 20 (the location where the guide 13 is disposed) with the timing of reading the image of the document G by the document reading unit 20. The guide 13 guides the fed document G to a first reading surface 21*a* described below. The document discharging unit 15 discharges the document G, whose image has been read by the document reading unit 20 (that has passed through the guide 13), outside the copier main body 2. The document discharging unit 15 includes a document collecting unit 16 located outside the copier main body 2 as viewed from the document discharging unit 15. The documents G discharged from the document discharging unit 15 are stacked and collected on the document collecting unit 16.

The document reading unit 20 includes the first reading surface 21*a* and a second reading surface 22*a*. The first reading surface 21*a* is located along the upper surface of a first contact glass 21 facing the guide 13 and is a surface for reading the image of the document G. The second reading surface 22*a* is adjacent to the right side of the first reading surface 21*a* and located over most of the portions on the right side of the first reading surface 21*a*. The second reading surface 22*a* is used in reading an image of a document G without the use of the document transporting unit 10. The second reading surface 22*a* is located in the upper surface of a second contact glass 22 and is a surface for reading the image of the document G.

The document reading unit 20 includes an illuminating unit 23, a first mirror 24, a second mirror 25, a third mirror 26, an imaging lens 27, and an imaging unit 28 inside the copier main body 2. Each of the illuminating unit 23 and first mirror 24 moves along the sub-scanning direction X. The second mirror 25 and third mirror 26 are located to the left of the illuminating unit 23 and the first mirror 24 in FIG. 1. Each of the second mirror 25 and third mirror 26 moves along the sub-scanning direction X while the optical path length, being the distance from the first reading surface 21*a* or second reading surface 22*a* to the imaging unit 28 through the first mirror 24, second mirror 25, third mirror 26, and imaging lens 27, is maintained constant.

The illuminating unit 23 is a light source for emitting light to the document G. The first mirror 24, second mirror 25, and third mirror 26 are mirrors for guiding light reflected from the document G to the imaging lens 27 while the optical path length is maintained constant. The imaging lens 27 focuses light from the third mirror 26 on the imaging unit 28. The imaging unit 28 is an imaging element for obtaining image data based on a focused light image by converting incident light into an electrical signal. An example of the imaging unit 28 can be an image sensor, such as a charge-coupled device (CCD) or a complementary metal-oxide semiconductor (CMOS).

The paper transporting unit 30 includes a second feed roller 31, a third feed roller 32, a pair of registration rollers 33, a switching unit 39, a first paper discharging unit 34, and a second paper discharging unit 38. The second feed roller 31 supplies paper T as a recording medium stored in a paper cassette 36 to the transfer unit 50. The third feed roller 32 supplies paper T on a bypass tray 37 to the transfer unit 50. The pair of registration rollers 33 feeds the paper T, or stops feeding the paper T, to match the timing of supplying the paper T to the transfer unit 50 with the timing when a toner image formed on an intermediate transfer belt 48 described below reaches the transfer unit 50. The pair of registration rollers 33 also corrects a skew occurring in feeding the paper T. The switching unit 39 switches the transporting direction of the paper T so as to feed the paper T ejected from the fixing unit 60 to either one of the first paper discharging unit 34 and the second paper discharging unit 38. The first paper discharging unit 34 and the second paper discharging unit 38 discharge the paper T with the toner image fixed thereon outside the copier main body 2. A discharged-paper collecting unit 35 is located outside the copier main body 2 as viewed from the first paper discharging unit 34. The sheets of paper T discharged from the first paper discharging unit 34 are stacked and collected on the discharged-paper collecting unit 35.

The image forming unit 40 is used for forming a toner image and includes photosensitive drums 41, charging units 42, laser scanner units 43, developing units 44, cleaning units 45, toner cartridges 46, primary transfer rollers 47, the intermediate transfer belt 48, and an opposite roller 49.

The photosensitive drums 41 (41*a*, 41*b*, 41*c*, and 41*d*) function as photosensitive members or image bearing members to form toner images of black, cyan, magenta, and yellow, respectively. The charging units 42, laser scanner units 43, developing units 44, and cleaning units 45 are arranged around the corresponding photosensitive drums 41*a*, 41*b*, 41*c*, and 41*d* in this order from upstream to downstream along the rotation direction of the photosensitive drums 41. Each of the charging units 42 charges the surface of the corresponding photosensitive drum 41. Each of the laser scanner units 43 is spaced away from the surface of the corresponding photosensitive drum 41 and scans and exposes the surface of the photosensitive drum 41 based on the image data relating to the document G read by the document reading unit 20. This removes electrical charges from the exposed portion and forms an electrostatic latent image on the surface of the photosensitive drum 41. Each of the developing units 44 causes toner to attach to the electrostatic latent image on the surface of the corresponding photosensitive drum 41 and forms a toner image. Each of the cleaning units 45 removes toner and other substances remaining on the surface of the corresponding photosensitive drum 41 after the electrical charges are eliminated from the surface of the photosensitive drum 41 by a neutralization device (not illustrated).

Each of the toner cartridges 46 accommodates toner of the corresponding color to be supplied to the corresponding developing unit 44. The toner cartridge 46 and the developing unit 44 are connected to each other with a toner supply channel (not illustrated).

The primary transfer rollers 47 (47*a*, 47*b*, 47*c*, and 47*d*) are located on opposite sides of the photosensitive drums 41*a*, 41*b*, 41*c*, and 41*d*, respectively, with respect to the intermediate transfer belt 48. The intermediate transfer belt 48 is a belt that passes through the image forming unit 40 and the transfer unit 50. A part of the intermediate transfer belt 48 is inserted between the photosensitive drums 41*a*, 41*b*, 41*c*, and 41*d*. and the primary transfer rollers 47*a*, 47*b*, 47*c*, 47*d*, respectively, and the toner images formed on the photosensitive drums 41*a*, 41*b*, 41*c*, and 41*d* are primarily-transferred to the intermediate transfer belt 48. The opposite roller 49 is located inside the intermediate transfer belt 48, which has an annular shape, and functions as a driving roller for moving the intermediate transfer belt 48 in the direction indicated by the arrow A in FIG. 1.

The transfer unit 50 includes a secondary transfer roller 51. The secondary transfer roller 51 is opposite to the opposite roller 49 with respect to the intermediate transfer belt 48. The secondary transfer roller 51 sandwiches a part of the intermediate transfer belt 48 with the opposite roller 49. In addition, the secondary transfer roller 51 secondarily-transfers the toner image primarily-transferred on the intermediate transfer belt 48 to the paper T.

The fixing unit 60 includes a heat rotating member 61 and a pressure rotating member 62. The heat rotating member 61 and pressure rotating member 62 sandwich the paper T with the toner image secondarily-transferred thereon and fix the toner onto the paper T by fusing and pressing the toner.

The post-processing device 100 includes a post-processing paper transporting unit 110 as a post-processing recording-medium transporting unit, a punching unit 120, a stapling unit 130, and a center-folding unit 140. The stapling unit 130 and center-folding unit 140 are located downstream of the punching unit 120 in the transporting direction of the paper T. That is, the paper T having passed through the punching unit 120 is supplied to the stapling unit 130 and center-folding unit 140.

The post-processing paper transporting unit 110 feeds the paper T by a driving roller (not illustrated) driven by a post-processing control unit 150 described below. Specifically, the post-processing paper transporting unit 110 includes an introducing unit 111, a branch guide 112, and a first discharging unit 113. The introducing unit 111 introduces the paper T discharged from the second paper discharging unit 38 of the copier main body 2 into the post-processing device 100 and feeds the paper T toward the punching unit 120. The branch guide 112 switches the transporting direction of the paper T discharged from the punching unit 120 to either the first discharging unit 113 or the stapling unit 130. The first discharging unit 113 discharges, from the post-processing device 100, the paper T discharged from the punching unit 120 and the paper T discharged from the stapling unit 130. A main tray 114 is located outside the post-processing device 100 downstream in the transporting direction of the paper T as viewed from the first discharging unit 113. The sheets of paper T discharged from the first discharging unit 113 are stacked and collected on the main tray 114.

The punching unit 120 performs punching to create a hole in the paper T for use in binding the paper T. The punching unit 120 includes a punching blade 121 movable in a vertical direction with respect to the paper T. The punching unit 120 creates a punching hole in the paper T by moving the punching blade 121 in the vertical direction and causing the punching blade 121 to penetrate the paper T when the fed paper T stops under the punching blade 121. The punching unit 120 includes a motor 122 (see FIG. 2) for moving the punching blade 121 up and down and a driving sensor 123 (see FIG. 2) for detecting whether the motor 122 is driven.

The stapling unit 130 performs stapling thereby binding and securing the paper T with a staple. The stapling unit 130 includes a paper receiving table 131, a receiving and stopping unit 132, a stapling processing unit 133, and a pair of transport rollers 134. The paper receiving table 131 temporarily retains a plurality of sheets of the paper T introduced from the punching unit 120 by switching made by the branch guide 112. The receiving and stopping unit 132 receives the bottom of the paper T and holds the paper T introduced into the paper receiving table 131. The stapling processing unit 133 moves to an adjacent area of the end or the center of the paper T retained on the paper receiving table 131 and performs stapling on the adjacent area of the end or the center of the paper T. The pair of transport rollers 134 feeds the bundle of paper T in which the central area of the paper T is stapled (saddle stitched) from the paper receiving table 131 to the center-folding unit 140.

The center-folding unit 140 performs center-folding, thereby folding the bundle of saddle-stitched paper T in two at the central area thereof. The center-folding unit 140 includes a center-folding receiving table 141, a pressing unit 142, a pair of center-folding rollers 143, and a second discharging unit 144. The bundle of paper T saddle-stitched by the stapling unit 130 is placed on the center-folding receiving table 141. The pressing unit 142 is movable in a direction perpendicular to the bundle of paper T placed on the center-folding receiving table 141. The pressing unit 142 presses the central area (the portion where stapling has been performed) of the bundle of paper T between the pair of center-folding rollers 143, which are opposite to the pressing unit 142 with respect to the bundle of paper T, by moving toward the bundle of paper T. The pair of center-folding rollers 143 folds the bundle of paper T pressed by the pressing unit 142 in the form of a booklet and feeds the folded bundle of paper T to the second discharging unit 144. The second discharging unit 144 discharges the folded bundle of paper T from the post-processing device 100. A discharge tray 145 is located outside the post-processing device 100 downstream in the transporting direction of the paper T as viewed from the second discharging unit 144. The bundle of paper T discharged from the second discharging unit 144 are collected on the discharge tray 145.

Figure 2:
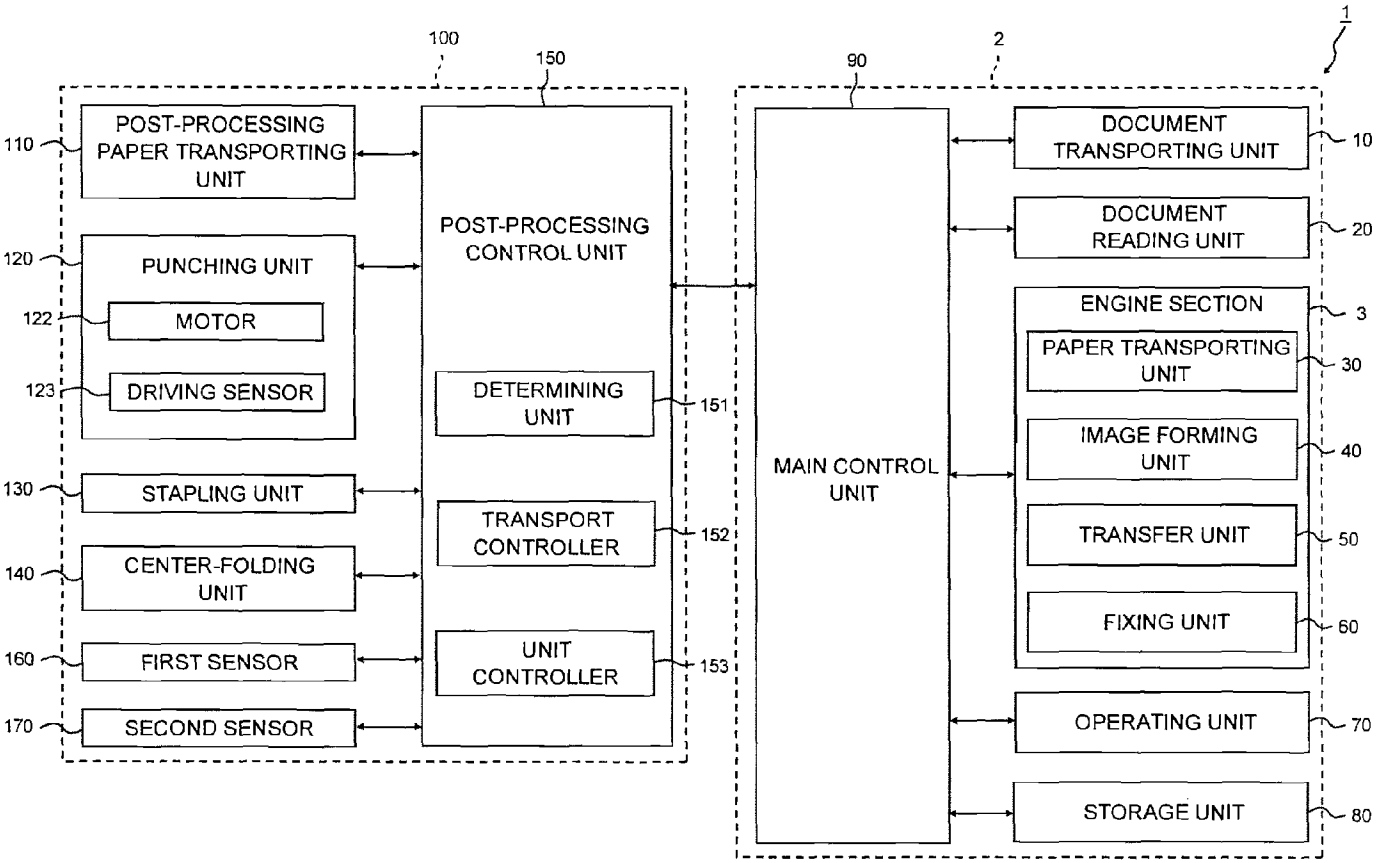
FIG. 2 is a block diagram that illustrates a functional configuration of the copier.

The functional configuration of the copier 1 is described below with reference to FIG. 2. FIG. 2 is a block diagram that illustrates the functional configuration of the copier 1.

The copier main body 2 includes the above-described components (document transporting unit 10, document reading unit 20, paper transporting unit 30, image forming unit 40, transfer unit 50, and fixing unit 60). The paper transporting unit 30, image forming unit 40, transfer unit 50, and fixing unit 60 form an engine section 3. The components described using FIG. 1 are not described here. The copier main body 2 further includes an operating unit 70, a storage unit 80, and a main control unit 90, in addition to the above-described functional configuration.

The operating unit 70 can include a numeric keypad (not illustrated), a touch panel (not illustrated), a start key (not illustrated), and other elements. The numeric keypad is used for entering a numeric character, such as the number of copies. A plurality of keys assigned to various functions (for example, the function of setting a scale in printing, the function of laying out multiple pages in a single sheet of paper T (e.g., 2 in 1 printing), and the function of executing punching, stapling, or center-folding) and other settings can be displayed on the touch panel. A key displayed on the touch panel is used for causing the copier 1 to carry out at least one of various functions. The start key is operated to execute printing. When a key in the operating unit 70 is operated, the operating unit 70 supplies the main control unit 90 with a signal indicating that the key has been operated.

The storage unit 80 can include a hard disk, a semiconductor memory, or other media. The storage unit 80 stores image data based on the document G read by the document reading unit 20. The storage unit 80 can store a control program used in the copier 1, data used in this control program, and other data.

The main control unit 90 can control the document transporting unit 10, document reading unit 20, engine section 3, operating unit 70, post-processing control unit 150, and other units.

The post-processing device 100 includes the above-described components (post-processing paper transporting unit 110, punching unit 120, stapling unit 130, and center-folding unit 140). The components described with reference to FIG. 1 are not described herein. The post-processing device 100 further includes a first sensor 160, a second sensor 170, and the post-processing control unit 150, in addition to the above-described components.

The first sensor 160 is located upstream of the punching unit 120 in the transporting direction of the paper T (see FIG. 1). The first sensor 160 is a sensor for detecting the paper T fed by the post-processing paper transporting unit 110. To detect the paper T, one example of the first sensor 160 can include an actuator (not illustrated) with which the paper T fed by the post-processing paper transporting unit 110 comes into contact and a photointerrupter (not illustrated) for detecting if light is blocked by the actuator with which the paper T comes into contact.

The second sensor 170 is located downstream of the punching unit 120 in the transporting direction of the paper T and upstream of the stapling unit 130 and center-folding unit 140 in the transporting direction of the paper T (see FIG. 1). The second sensor 170 is a sensor for detecting the paper T fed by the post-processing paper transporting unit 110. To detect the paper T, one example of the second sensor 170 can include an actuator (not illustrated) with which the paper T fed by the post-processing paper transporting unit 110 comes into contact and a photointerrupter (not illustrated) for detecting if light is blocked by the actuator with which the paper T comes into contact.

The post-processing control unit 150 controls the post-processing paper transporting unit 110, punching unit 120, stapling unit 130, and center-folding unit 140.

The post-processing control unit 150 includes a determining unit 151, a transport controller 152, and a unit controller 153.

The determining unit 151 determines whether the punching unit 120 has failed. The determining unit 151 determines that the punching unit 120 has failed, for example, if the post-processing control unit 150 controls the motor 122 to move the punching blade 121 upward or downward, but the driving sensor 123 does not detect driving of the motor 122.

If the determining unit 151 determines that the punching unit 120 has failed, the transport controller 152 controls the post-processing paper transporting unit 110 such that it supplies the paper T to the punching unit 120. The transport controller 152 communicates with the main control unit 90 and causes the paper transporting unit 30 to feed the paper T stored in the paper cassette 36 to the post-processing paper transporting unit 110 through the main control unit 90. If the punching unit 120 fails, the post-processing device 100 (copier 1) is unable to identify the location where the punching blade 121 stops. If upward or downward movement of the punching blade 121 stops in progress, the punching blade 121 may block a transport path 115 for the paper T. Thus the transport controller 152 supplies the paper T to the faulty punching unit 120 to check whether the punching blade 121 has blocked the transport path 115 for the paper T.

That is, if passage of the leading end of the paper T through an arrangement position of the second sensor 170 is detected based on the signal from the second sensor 170 within a first time period after detection of passage of the leading end of the paper T through an arrangement position of the first sensor 160 based on the signal from the first sensor 160, the transport controller 152 controls the post-processing paper transporting unit 110 such that the paper T is allowed to be supplied to the stapling unit 130 and center-folding unit 140. When passage of the leading end of the paper T through the arrangement position of the second sensor 170 is detected within the first time period after detection of passage of the leading end of the paper T through the arrangement position of the first sensor 160, the transport controller 152 determines that the punching blade 121 has not blocked the transport path 115 for the paper T. In this situation, the transport controller 152 is able to supply the paper T to the stapling unit 130 and center-folding unit 140. Accordingly, when a user selects stapling or center-folding by operating the above-described touch panel, the transport controller 152 controls the post-processing paper transporting unit 110 such that the paper T is fed to the stapling unit 130 or center-folding unit 140.

In this situation, the paper T sent to the punching unit 120 to check whether the punching blade 121 has blocked the transport path 115 for the paper T is discharged from the first discharge unit 113 to the main tray 114.

On the other hand, if passage of the leading end of the paper T sent to the punching unit 120 through the arrangement position of the second sensor 170 is not detected within the first time period after detection of passage of the leading end of the paper T through the arrangement position of the first sensor 160, the transport controller 152 controls the post-processing paper transporting unit 110 such that the paper T is not allowed to be fed. If passage of the leading end of the paper T through the arrangement position of the second sensor 170 is not detected within the first time period after detection of passage of the leading end of the paper T through the arrangement position of the first sensor 160, the transport controller 152 determines that the punching blade 121 has blocked the transport path 115 for the paper T. In this situation, the transport controller 152 is unable to supply the paper T to the stapling unit 130 and center-folding unit 140. Accordingly, the transport controller 152 does not allow the post-processing paper transporting unit 110 to feed the paper T.

In this situation, the paper T sent to the punching unit 120 to check whether the punching blade 121 has blocked the transport path 115 for the paper T is stuck in the punching unit 120 (a jam occurs). However, because a gap is present between the post-processing device 100 and the main body of the copier 1 (not illustrated in FIG. 1), the stuck paper T escapes to the gap. Accordingly, the copier 1 can minimize damage caused by the occurrence of the jam. The paper T stuck in the punching unit 120 is easily removable by the user, for example, laterally moving the post-processing device 100.

The first time period described above is less than a second time period described below. The second time period is the time period for use in determining that a jam has occurred in the punching unit 120 when the determining unit 151 determines that the punching unit 120 has not failed (normal jam detection time period).

That is, when the punching unit 120 does not fail, if passage of the leading end of the paper T through the arrangement position of the second sensor 170 is not detected even when the second time period has elapsed since detection of passage of the leading end of the paper T through the arrangement position of the first sensor 160, the transport controller 152 determines that a jam has occurred in the punching unit 120.

In contrast, when the punching unit 120 fails, the transport controller 152 determines that a jam has occurred in the punching unit 120 based on the first time period, which is less than the second time period (normal jam detection time period). One example of the first time period is half the second time period.

When determining that a jam has occurred, the transport controller 152 stops the feeding the paper T operation performed by the post-processing paper transporting unit 110. The transport controller 152 communicates with the main control unit 90 and stops the feeding the paper T operation performed by the sheet transporting unit 30 through the main control unit 90. Accordingly, the copier 1 can minimize damage caused by stuck paper when a jam occurs in the punching unit 120.

When the determining unit 151 determines that the punching unit 120 has failed, if passage of the leading end of the paper T sent to the punching unit 120 through the arrangement position of the second sensor 170 is detected within the first time period after detection of passage of the leading end of the paper T through the arrangement position of the first sensor 160, the unit controller 153 makes the stapling unit 130 and center-folding unit 140 operable. That is, when the punching unit 120 fails and the punching blade 121 does not block the transport path 115 for the paper T, the unit controller 153 makes the stapling unit 130 and center-folding unit 140 operable. Specifically, the unit controller 153 supplies the main control unit 90 with first information for making the stapling unit 130 and center-folding unit 140 operable. The main control unit 90 makes the key assigned to stapling and the key assigned to center-folding displayed on the above-described touch panel selectable based on the first information. The main control unit 90 makes the key assigned to punching unselectable based on the first information.

On the other hand, when the determining unit 151 determines that the punching unit 120 has failed, if passage of the leading end of the paper T sent to the punching unit 120 through the arrangement position of the second sensor 170 is not detected within the first time period after detection of passage of the leading end of the paper T through the arrangement position of the first sensor 160, the unit controller 153 makes the punching unit 120, the stapling unit 130, and center-folding unit 140 inoperable. That is, when the punching unit 120 fails and the punching blade 121 blocks the transport path 115 for the paper T, the unit controller 153 makes the punching unit 120, the stapling unit 130, and center-folding unit 140 inoperable. Specifically, the unit controller 153 supplies the main control unit 90 with second information for making the punching unit 120, the stapling unit 130, and center-folding unit 140 inoperable. The main control unit 90 makes the key assigned to punching, the key assigned to stapling, and the key assigned to center-folding displayed on the above-described touch panel unselectable based on the second information.

Figure 3:
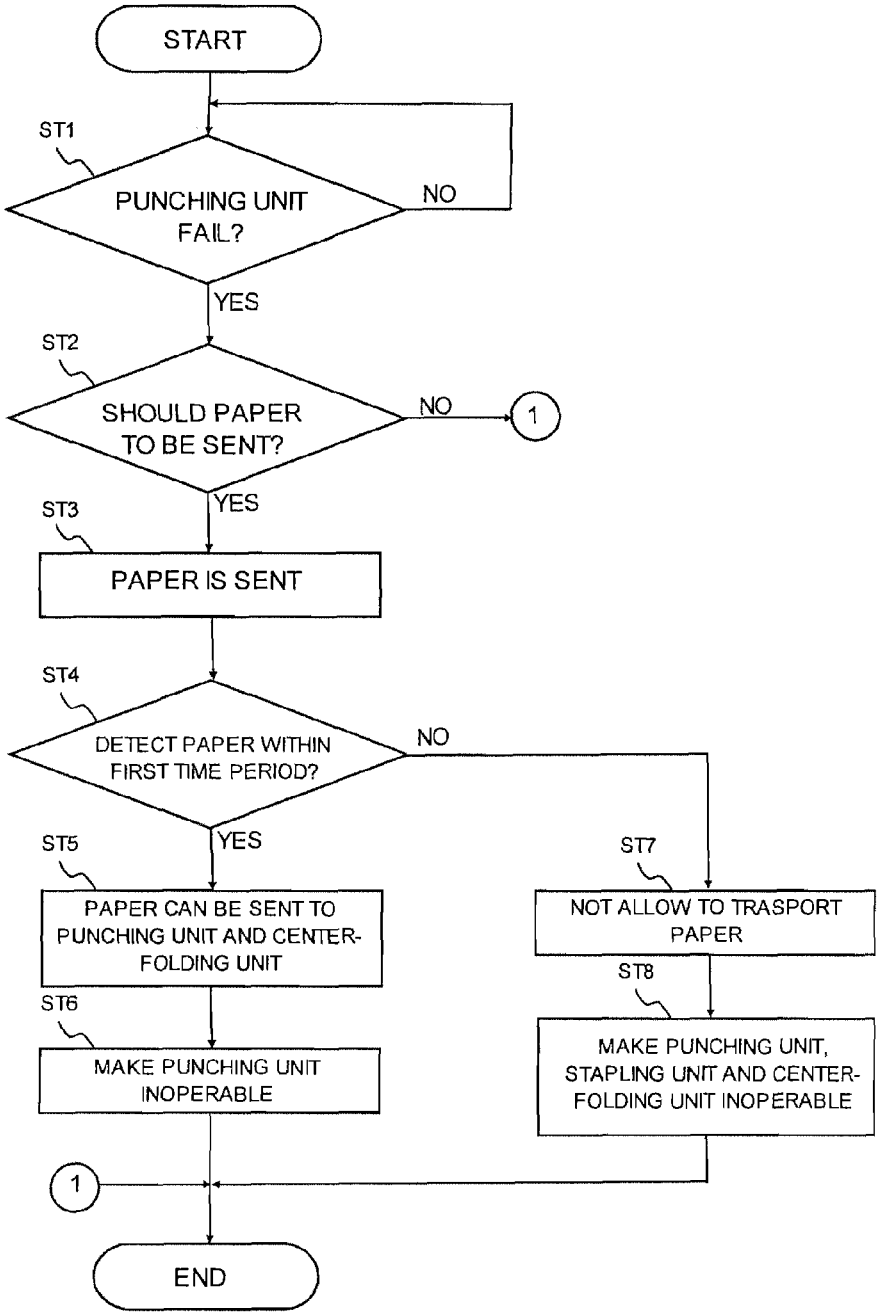
FIG. 3 is a flowchart for describing an operation of the copier when paper is sent to a punching unit.

An operation of the copier 1 when the punching unit 120 fails is described below with reference to FIG. 3. FIG. 3 is a flowchart for describing an operation of the copier 1 when paper T is sent to the punching unit 120.

In step ST1, the determining unit 151 determines whether the punching unit 120 has failed based on the detection using the driving sensor 123. If the punching unit 120 has not failed (No), determination in step ST1 is conducted again. If the punching unit 120 has failed (Yes), processing proceeds to step ST2.

In step ST2, the transport controller 152 determines whether the paper T is to be sent to the punching unit 120 (a passage check is to be conducted) based on the selection by a user.

That is, when the punching unit 120 fails, the main control unit 90 displays a button for conducting a passage check on the above-described touch panel to determine whether the punching blade 121 has blocked the transport path 115 for the paper T (that is, to determine whether the punching blade 121 interferes with transportation of the paper T). If the transport controller 152 determines that the conduct of a passage check is selected by a user operating the touch panel (Yes), processing proceeds to step ST3. If the transport controller 152 determines that the conduct of a passage check is not selected by a user (No), processing is completed.

In step ST3, the transport controller 152 controls the post-processing paper transporting unit 110 such that paper T is allowed to be sent to the punching unit 120. The transport controller 152 communicates with the main control unit 90 and causes the paper transporting unit 30 to feed the paper T in the paper cassette 36 to the post-processing paper transporting unit 110 through the main control unit 90.

In step ST4, the transport controller 152 determines whether passage of the leading end of the paper T through the arrangement position of the second sensor 170 has been detected within the first time period after detection of passage of the leading end of the paper T through the first sensor 160. If the passage of the leading end of the paper T through the arrangement position of the second sensor 170 has been detected within the first time period (Yes), processing proceeds to step ST5. If the passage of the leading end of the paper T through the arrangement position of the second sensor 170 has not been detected within the first time period (No), processing proceeds to step ST7.

In step ST5, the transport controller 152 allows the paper T to be supplied to the stapling unit 130 and center-folding unit 140 and processing proceeds to step ST6.

In step ST6, the unit controller 153 makes the stapling unit 130 and center-folding unit 140 operable and makes the punching unit 120 inoperable.

If "No" is determined in step ST4, the transport controller 152 does not allow the post-processing paper transporting unit 110 to feed the paper T in step ST7 and processing proceeds to step ST8.

In step ST8, the unit controller 153 makes the punching unit 120, stapling unit 130, and center-folding unit 140 inoperable.

After step ST6 and step ST8, when the paper T is sent to the punching unit 120, processing performed by the copier 1 is completed.

As described above, the copier 1 (post-processing device 100) according to an embodiment can offer the advantageous effects described below.

That is, when the determining unit 151 determines that the punching unit 120 has failed, the copier 1 (post-processing device 100) according to an embodiment controls the post-processing paper transporting unit 110 such that it supplies the paper T to the punching unit 120. In addition, when determining that passage of the leading end of the paper T through the arrangement position of the second sensor 170 has been detected within the first time period after detection of passage of the leading end of the paper T through the arrangement position of the first sensor 160 (when the punching unit 120 does not block the transport path 115 for the paper T), the copier 1 controls the post-processing paper transporting unit 110 such that the paper T is allowed to be supplied to the stapling unit 130 and center-folding unit 140.

In contrast, when determining passage of the leading end of the paper T through the arrangement position of the second sensor 170 is not detected within the first time period after detection of passage of the leading end of the paper T through the arrangement position of the first sensor 160 (when the punching unit 120 blocks the transport path 115 for the paper T), the copier 1 controls the post-processing paper transporting unit 110 such that the paper T is not allowed to be fed.

In this way, the copier 1 (post-processing device 100) can identify the failure state of the punching blade 121. The copier 1 (post-processing device 100) can identify the faulty state of the punching unit 120 without having to add a function. The copier 1 (post-processing device 100) can make the stapling unit 130 and center-folding unit 140 usable, depending on the faulty state of the punching unit 120.

When the punching unit 120 fails, but the punching blade 121 does not block the transport path 115 for the paper T, the copier 1 (post-processing device 100) makes the punching unit 120 inoperable and makes the stapling unit 130 and center-folding unit 140 operable. In contrast, when the punching blade 121 blocks the transport path 115 for the paper T, the copier 1 (post-processing device 100) makes the punching unit 120, stapling unit 130, and center-folding unit 140 inoperable. Accordingly, when the punching blade 121 does not block the transport path 115 for the paper T, the copier 1 (post-processing device 100) can enable the usable functions.

The first time period is less than the second time period. The second time period is the time period for use in determining that a jam of the paper T occurs in the punching unit 120 when the determining unit 151 determines that the punching unit 120 has not failed. Accordingly, the copier 1 (post-processing device 100) can minimize damage caused by the paper T when a jam of the paper T occurs in the punching unit 120.

The present disclosure is not limited to the above-described embodiment and can be carried out in various forms.

The present disclosure is not limited to the configuration in which the post-processing control unit 150 includes the determining unit 151, transport controller 152, and unit controller 153 described in the above-described embodiment. That is, at least one of the determining unit 151, transport controller 152, and unit controller 153 may be included in the main control unit 90. The center-folding unit 140 included in the post-processing device 100 in an embodiment is optional. In an embodiment, the transport controller 152 detects passage of the leading end (first end) of the paper T, the leading end being one end thereof, through the arrangement position of each of the first sensor 160 and second sensor 170. Alternatively, the transport controller 152 may detect passage of the trailing end (second end) of the paper T, the trailing end being the other end thereof, through the arrangement position of each of the first sensor 160 and second sensor 170. Alternatively, the transport controller 152 may detect passage of the leading end of the paper T through the arrangement position of the first sensor 160 and then detect passage of the trailing end of the paper T through the arrangement position of the second sensor 170.

The copier 1 in an embodiment is a color copier. The copier 1 is not limited to this configuration. The copier 1 may be a black-and-white copier.

The copier 1 in an embodiment is one in which a toner image is transferred to the paper T through the intermediate transfer belt 48 (indirect transfer type). The copier 1 is not limited to this configuration. The copier 1 may be one in which a toner image on the photosensitive drum is directly transferred to the paper (direct transfer type).

The copier 1 in an embodiment has a configuration in which printing is performed on a single side of the paper T. The copier 1 is not limited to this configuration. The copier 1 may have a configuration in which printing is performed on both sides of the paper.

The image forming apparatus in the present disclosure is not limited to the above-described copier 1. That is, the image forming apparatus in the present disclosure may be a multifunctional peripheral having the copying function, printing function, and scanning function. Alternatively, it may be a facsimile machine or printer.

The recording medium on which a toner image is fixed by the image forming apparatus in the present disclosure is not limited to the paper T. For example, the recording medium may be a film sheet, such as an overhead projector (OHP) transparency sheet.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A post-processing device comprising:

a post-processing recording-medium transporting unit configured to feed a recording medium;

a punching unit configured to create a hole in the recording medium;

a stapling unit located downstream of the punching unit in a transporting direction of the recording medium;

a first sensor for detecting a recording medium fed by the post-processing recording-medium transporting unit, the first sensor being located upstream of the punching unit in the transporting direction of the recording medium;

a second sensor for detecting a recording medium fed by the post-processing recording-medium transporting unit, the second sensor being located downstream of the punching unit in the transporting direction of the recording medium and upstream of the stapling unit in the transporting direction of the recording medium;

a determining unit configured to determine whether the punching unit failed;

a transport controller configured to control the post-processing recording-medium transporting unit such that, when the determining unit determines that the punching unit failed, a first recording medium is fed to the punching unit and, if passage of the first recording medium through an arrangement position of the second sensor is detected within a predetermined first time period after detection of passage of the first recording medium through an arrangement position of the first sensor, a second recording medium is allowed to be fed to the stapling unit; and a unit controller, wherein when the determining unit determines that the punching unit failed, if the passage of the first recording medium through the arrangement position of the second sensor is detected within the first time period after the detection of the passage of the first recording medium through the arrangement position of the first sensor, the unit controller makes, with respect to the punching unit and the stapling unit, only the stapling unit operable.

2. The post-processing device according to claim 1, wherein the transport controller controls the post-processing recording-medium transporting unit such that, if the passage of the first recording medium through the arrangement position of the second sensor is not detected within the first time period after the detection of the passage of the first recording medium through the arrangement position of the first sensor, the second recording medium is not allowed to be fed.

3. The post-processing device according to claim 1, wherein when the determining unit determines that the punching unit failed, if the passage of the first recording medium through the arrangement position of the second sensor is not detected within the first time period after the detection of the passage of the first recording medium through the arrangement position of the first sensor, the unit controller makes both the punching unit and the stapling unit inoperable.

4. The post-processing device according to claim 1, wherein the first time period is less than a predetermined second time period for use in determining whether, when the determining unit determines that the punching unit did not fail, a jam of the recording medium occurred in the punching unit.

5. An image forming apparatus comprising:

a main device configured to form an image on a recording medium; and a post-processing device configured to perform post-processing on the recording medium, the post-processing device including:

a post-processing recording-medium transporting unit configured to feed the recording medium;

a punching unit configured to create a hole in the recording medium;

a stapling unit located downstream of the punching unit in a transporting direction of the recording medium;

a first sensor for detecting a recording medium fed by the post-processing recording-medium transporting unit, the first sensor being located upstream of the punching unit in the transporting direction of the recording medium;

a second sensor for detecting a recording medium fed by the post-processing recording-medium transporting unit, the second sensor being located downstream of the punching unit in the transporting direction of the recording medium and upstream of the stapling unit in the transporting direction of the recording medium;

a determining unit configured to determine whether the punching unit failed;

a transport controller configured to control the post-processing recording-medium transporting unit such that, when the determining unit determines that the punching unit failed, a first recording medium is fed to the punching unit and, if passage of the first recording medium through an arrangement position of the second sensor is detected within a predetermined first time period after detection of passage of the first recording medium through an arrangement position of the first sensor, a second recording medium is allowed to be fed to the stapling unit; and a unit controller, wherein when the determining unit determines that the punching unit failed, if the passage of the first recording medium through the arrangement position of the second sensor is detected within the first time period after the detection of the passage of the first recording medium through the arrangement position of the first sensor, the unit controller makes, with respect to the punching unit and the stapling unit, only the stapling unit operable.

6. The image forming apparatus according to claim 5, wherein the transport controller controls the post-processing recording-medium transporting unit such that, if the passage of the first recording medium through the arrangement position of the second sensor is not detected within the first time period after the detection of the passage of the first recording medium through the arrangement position of the first sensor, the second recording medium is not allowed to be fed.

7. The image forming apparatus according to claim 5, wherein when the determining unit determines that the punching unit failed, if the passage of the first recording medium through the arrangement position of the second sensor is not detected within the first time period after the detection of the passage of the first recording medium through the arrangement position of the first sensor, the unit controller makes both the punching unit and the stapling unit inoperable.

8. The image forming apparatus according to claim 5, wherein the first time period is less than a predetermined second time period for use in determining whether, when the determining unit determines that the punching unit did not fail, a jam of the recording medium occurred in the punching unit.

9. The image forming apparatus according to claim 5, wherein an indication for use in selecting whether the first recording medium is to be fed to the punching unit is displayed when the punching unit failed to determine whether a punching blade of the punching unit interferes with transportation of a recording medium.

10. A post-processing device comprising:

a post-processing recording-medium transporting unit configured to feed a recording medium;

a punching unit configured to create a hole in the recording medium;

a stapling unit located downstream of the punching unit in a transporting direction of the recording medium;

a first sensor for detecting a recording medium fed by the post-processing recording-medium transporting unit, the first sensor being located upstream of the punching unit in the transporting direction of the recording medium;

a second sensor for detecting a recording medium fed by the post-processing recording-medium transporting unit, the second sensor being located downstream of the punching unit in the transporting direction of the recording medium and upstream of the stapling unit in the transporting direction of the recording medium;

a determining unit configured to determine whether the punching unit failed; and a transport controller configured to control the post-processing recording-medium transporting unit such that, when the determining unit determines that the punching unit failed, a first recording medium is fed to the punching unit and, if passage of the first recording medium through an arrangement position of the second sensor is detected within a predetermined first time period after detection of passage of the first recording medium through an arrangement position of the first sensor, a second recording medium is allowed to be fed to the stapling unit, wherein the first time period is less than a predetermined second time period for use in determining whether, when the determining unit determines that the punching unit did not fail, a jam of the recording medium occurred in the punching unit.

* * * * *